US007677354B2

(12) United States Patent
Osada et al.

(10) Patent No.: US 7,677,354 B2
(45) Date of Patent: Mar. 16, 2010

(54) ELECTRONIC APPARATUS HAVING SPEAKER UNIT INCORPORATED THEREIN

(75) Inventors: Yasuo Osada, Saitama (JP); Yutaka Sato, Kanagawa (JP)

(73) Assignee: Sony Corporation (JP)

( * ) Notice: Subject to any disclaimer, the term of this patent is extended or adjusted under 35 U.S.C. 154(b) by 483 days.

(21) Appl. No.: 11/071,619

(22) Filed: Mar. 3, 2005

(65) Prior Publication Data

US 2005/0211498 A1 Sep. 29, 2005

(30) Foreign Application Priority Data

Mar. 23, 2004 (JP) ..... P2004-084024

(51) Int. Cl.
*H04R 1/02* (2006.01)

(52) U.S. Cl. ..... 181/156; 181/198; 181/199; 381/165; 381/345

(58) Field of Classification Search ..... 181/156, 181/198, 199; 381/345, 165
See application file for complete search history.

(56) References Cited

U.S. PATENT DOCUMENTS 4,811,403 A * 3/1989 Henricksen et al. ..... 381/87
5,115,473 A * 5/1992 Yamagishi et al. ..... 381/338
5,446,793 A * 8/1995 Piccaluga et al. ..... 381/338
5,547,272 A * 8/1996 Paterson et al. ..... 312/223.2
5,696,357 A * 12/1997 Starobin ..... 181/156
5,792,999 A * 8/1998 Arnold et al. ..... 181/141
6,321,869 B1 * 11/2001 Park ..... 181/199
6,390,231 B1 * 5/2002 Howze ..... 181/148
2004/0017924 A1 * 1/2004 Kuratani et al. ..... 381/349

FOREIGN PATENT DOCUMENTS

DE 3113281 A1 * 10/1982
JP 63074297 A * 4/1988
JP 05098925 A * 4/1993
JP 05098926 A * 4/1993
JP 6233367 8/1994

* cited by examiner

*Primary Examiner*—Jeffrey Donels
*Assistant Examiner*—Jeremy Luks
(74) *Attorney, Agent, or Firm*—Lerner, David, Littenberg, Krumholz & Mentlik, LLP

(57) ABSTRACT

An electronic apparatus having a structure in which the inside of a cabinet having a speaker unit incorporated therein is effectively cooled, so that the speaker unit satisfactorily plays back a bass sound in which the speaker cabinet has at least two bass-reflex ducts. One bass-reflex duct is used for air-discharge, through which air in the cabinet is discharged by a fan unit, and another bass-reflex duct is used for air-intake. Thus, the inside of the speaker cabinet is effectively cooled while making use of the bass-reflex effect.

5 Claims, 16 Drawing Sheets

FIG. 15

LOWEST RESONANT FREQUENCY OF SPEAKER UNIT $$f0 = \frac{1}{2\pi}\sqrt{\frac{s0}{m0}} \quad \cdots (1)$$

RESONANT FREQUENCY OF SPEAKER CABINT $$f0b = \frac{1}{2\pi}\sqrt{\frac{sc}{ml}} \quad \cdots (2)$$

ELECTRONIC APPARATUS HAVING SPEAKER UNIT INCORPORATED THEREIN

BACKGROUND OF THE INVENTION

1. Field of the Invention

The present invention relates to an electronic apparatus having a speaker unit incorporated therein, such as a speaker apparatus, a monitor receiver or a radio receiver including at least one of a variety of display devices such as a plasma display device.

2. Description of the Related Art

A speaker apparatus produces a sound when a cone of a speaker unit thereof vibrates back and forth and generates a compressional wave in a space. When the cone moves forward, air in front of the cone is compressed, and air at the back of the same is quite contrarily rarefied. The speaker unit includes a cone and a magnetic circuit section, and the speaker apparatus means an overall apparatus including a speaker cabinet having the speaker unit incorporated therein.

When the speaker unit is sounded without attaching to a baffle, compressional states of air in front of and at the back of the unit are mixed and cancelled with each other, resulting in producing no sound. Although the-speaker unit may be attached to a large baffle so as to prevent sounds in front of and at the back of the unit, having mutually reverse phases, from being mixed with each other, a baffle effective to a low-frequency sound is enormously large in size and is accordingly unpractical.

In view of this problem, as shown in FIG. 13 by way of example, a bass-reflex speaker cabinet is hitherto used, having a structure in which a sound emitted from the rear of a cone of a speaker unit 901 passes through a bass-reflex duct (port, aperture) 902 disposed in a cabinet 900 so as to have a phase reversed by 180 degrees, in agreement with that of a sound emitted in front of the cone, and is then emitted from the speaker unit. While requiring a severe design, the bass-reflex speaker cabinet has advantages of, for example, a smaller size and much more satisfactorily playing back bass sound than an enclosed one.

FIG. 13A and FIG. 13B are respectively a sectional view and an elevational view of an example bass-reflex speaker apparatus. The bass-reflex speaker apparatus shown in FIG. 13 has an equivalent circuit shown in FIG. 14. In this case, the lowest resonant frequency f0 of the speaker unit 901 and the resonant frequency f0*b* of the speaker cabinet 900 are respectively given by expressions (1) and (2) shown in FIG. 15.

With respect to references characters shown in FIG. 14, Fv defines a vibromotive force exerted on a speaker vibrating system; Ev defines a voltage applied on a voice coil, B defines a flux density in a gap; l and Rv respectively define a length and a direct current resistance of the voice coil; vd defines a speed of a cone, vp defines a speed of air in a bass-reflex duct; m0, s0, and r0 respectively define an equivalent mass, an equivalent stiffness, and an equivalent resistance of the speaker vibrating system; sc defines an equivalent stiffness of a cabinet, vc defines a speed of air in the cabinet, and ml defines an equivalent mass of the duct.

For example, a bass-reflex speaker apparatus disclosed in Japanese Unexamined Patent Application Publication NO. 6-233367 has a structure in which, by making use of arrangement of a bass-reflex duct in a cabinet, a ventilation duct usable also as a bass-reflex duct is disposed in the vicinity of a yoke constituting the magnetic circuit of the apparatus so as to cool the magnetic circuit by air flowing in and out the ventilation duct and also to provide an bass-reflex effect.

While an audio amplifier is additionally needed to drive a speaker apparatus and is generally disposed independently from the speaker apparatus, another speaker apparatus having a structure in which an audio amplifier and so forth are built in its speaker cabinet in order to meet the requirements of reducing the size and saving a space of an audio system is also available in the market.

Also, of monitor receivers such as a television receiver including a display device such as a cathode ray tube (CRT), a liquid crystal display device, or a plasma display device, one having a structure in which a speaker unit is incorporated in its cabinet is also available in the market. With this structure, the speaker apparatus is not required to be disposed together with the monitor receiver and is accordingly useful.

In the meantime, with respect to a speaker apparatus or a monitor receiver having a speaker unit and additionally a variety of electrical circuits, built therein, since heat generated by the built-in electrical circuits remains in its cabinet having the speaker unit incorporated therein, such an electronic apparatus requires an elaborate design effort so as to effectively convey the heat remaining in the cabinet outside the apparatus.

To this end, the apparatus is designed so as to have an example structure in which a heat pipe, a thermally conductive material or the like is connected to a heating section of an amplifier circuit or the like so as to release heat in the cabinet having the speaker unit incorporated therein outside the apparatus. Unfortunately, this structure causes a complicated mechanism and also an increased cost. In addition, since as the greater the output power of an amplifier, the greater amount of generated heat, the maximum power of the amplifier is limited, thereby inhibiting a large sound from being played back.

In order to solve the above problem, disposing a ventilation duct serving as a ventilation path and also a bass-reflex duct in the speaker cabinet as disclosed in the foregoing patent document is conceivable. Unfortunately, only air flowing in and out the same ventilation duct does not effectively cool the inside of the cabinet. Especially, in the case of an electronic apparatus such as a speaker apparatus or a monitor receiver having a variety of electrical circuits incorporated therein, only air flowing in and out in its ventilation duct does not sufficiently cool the inside of the cabinet thereof.

SUMMARY OF THE INVENTION

In view of the above problems, it is an object of the present invention to provide an electronic apparatus such as a speaker apparatus, having a speaker unit incorporated therein, in which, by effectively making use of bass-reflex ducts in a bass-reflex cabinet, the inside of the cabinet is effectively cooled and bass sounds are satisfactorily played back.

In order to solve the above problems, an electronic apparatus according to the present invention includes a cabinet having a speaker unit disposed therein; at least two bass-reflex ducts disposed in the cabinet; and at least one fan unit serving as blowing means disposed in the cabinet and forming a flow of direct current air so as to discharge air in the cabinet through at least one of the foregoing at least two bass-reflex ducts.

With the electronic apparatus according to the present invention, the cabinet having the speaker unit incorporated therein has at least two bass-reflex ducts disposed therein, and at least one of them is used for discharging air in the speaker cabinet therethrough with the blowing means while the others are used for air-intake.

With this structure, a flow of direct current air (in a single direction) is formed in the cabinet, external air is taken in the cabinet, and air in the cabinet is discharged, whereby the electronic apparatus having a speaker unit incorporated therein and effectively cooling the inside of the cabinet is achieved while maintaining its bass-reflex effect and advantageously playing back bass sounds.

Advantages

According to the present invention, air in the cabinet of an electronic apparatus having a speaker unit disposed therein can be discharged outside the cabinet and external air can be taken in the cabinet, thereby effectively cooling the inside of the cabinet and preventing the temperature of the same from rising.

With this structure, the electronic apparatus is free from an elaborate design effort or the like needed for a known speaker having amplifiers built therein, with which heat generated by heating sections of amplifier circuits is effectively released outside the speaker unit by using a heat pipe or a thermally conductive material, whereby the electronic apparatus having a speaker unit incorporated therein is achieved without a complicated structure and an increased cost.

When the present invention is applied to a variety of electronic apparatuses such as a monitor receiver having a speaker unit incorporated in its cabinet, the electronic apparatus is free from problems such as a complicated structure having a very large number of holes perforated in the cabinet for releasing heat remaining in the cabinet, and also an increased cost.

Also, since the cabinet can be utilized as a bass-reflex speaker cabinet, a bass-reflex reproduction feature is drastically improved, thereby achieving an electronic apparatus having a speaker unit incorporated therein and an improved feature of playing back bass sounds.

As described above, by disposing at least two bass-reflex ducts and the fan unit in the cabinet serving as an enclosure of a bass-reflex speaker apparatus as an example of the electronic apparatus, a flow of direct current air is formed such that external air is taken in the cabinet and air remaining in the same is discharged outside, thereby inhibiting electronic components, electronic circuits or the like incorporated in the cabinet from heating, without adversely affecting the frequency characteristic of the bass-reflex speaker apparatus serving as an air resonant apparatus.

By passing direct current air through at least two, that is, a plurality of the bass-reflex ducts by the fan units, the number of which is equal to or smaller than the total number of bass-reflex ducts, direct current air in the speaker cabinet is discharged outside through a part of the bass-reflex ducts, and external direct current air is taken in the speaker cabinet through the other part of the reflex ducts, thereby effectively cooling the inside of the speaker cabinet.

Since the fan unit is arranged so as not to closely contact with the opening of each bass-reflex duct, the bass-reflex speaker apparatus does not loose its specific feature.

When the heating sections of a plurality of electronic circuits, electronic components, or the like built in the cabinet are arranged in a direction of openings, allowing air to flow therethrough, of a part of the bass-reflex ducts used for taking air in the cabinet, the inside of the cabinet is effectively cooled.

By arranging the air-intake and air-discharge bass-reflex ducts so as to be kept the most away from each other in the cabinet such that the a flow of air taken in through the air-intake bass-reflex duct and discharged through the air-discharge bass-reflex duct is made as long as possible, and by substantially linearly arranging the heating elements of the plurality of electronic components or the like along the flow of air, the heating elements of the plurality of electronic components or the like are effectively cooled.

When an air-straightening plate is disposed in the cabinet, relatively cool air taken in the air-intake bass-reflex duct forms a flow changed other than a linear shape, on the way of reaching the air-discharge bass-reflex duct, the heating elements of the plurality of electronic components or the like are cooled without substantially linearly arranging them between the air-intake and air-discharge bass-reflex ducts.

When the air-straightening plate is disposed in the cabinet, the heating elements of the plurality of electronic components or the like are cooled without arranging the air-intake and air-discharge bass-reflex ducts in the speaker cabinet so as to be kept the most away from each other.

When the heating elements of the plurality of electronic circuits or the like are arranged along the flow of air extending from the air-intake to air-discharge bass-reflex ducts disposed in the cabinet in order increasing heating temperature of the same, these elements are cooled one by one by relatively cool air taken from the outside, starting from the one having a relatively low heating temperature, whereby the inside of the cabinet is effectively cooled.

In the case of an electronic apparatus such as a plasma display device extending relatively long in the vertical direction in a room, when the air-intake bass-reflex duct is disposed at the lower part of the cabinet, relatively cool air remaining at the lower part of the room is taken in the cabinet, and the heating elements of the electronic circuits or the like are cooled, thereby improving the cooling efficiency of the cabinet.

When the air-intake and air-discharge bass-reflex ducts are respectively disposed at the lower and upper parts of the cabinet, even when the power of the electronic apparatus is turned off immediately after its use, since air heated by the heating elements of the electronic circuits or the like in the cabinet moves up, the heated air is discharged through the air-discharge bass-reflex duct disposed at the upper part of the cabinet; thus, relatively cool air having an amount corresponding to that of the discharged air is taken in the cabinet through the air-intake bass-reflex duct disposed at the lower part of the cabinet, whereby the heating elements of the electronic circuits or the like can be cooled.

In the case of an electronic apparatus such as a plasma display device extending relatively long in the vertical direction in a room, when the air-intake and air-discharge bass-reflex ducts are respectively disposed at the upper and lower parts of the cabinet, hot air remaining at the upper part of the room can be taken in the cabinet through the upper air-intake bass-reflex duct and is discharged through the lower discharge air-discharge duct, whereby the speaker cabinet also serves as a so-called air circulator reducing a difference in temperatures at the upper and lower parts of the room.

In the case of an electronic apparatus such as a plasma display device extending relatively long in the vertical direction in a room, when the air-intake and air-discharge bass-reflex ducts are respectively disposed at the upper and lower part of the cabinet, air heated by the heating elements of the electronic components or the like is discharged through the lower bass-reflex duct, whereby the hot air discharged through the lower duct contributes to making the distribution of the room temperature uniform, in addition to the above-described circulator effect.

Since the fan unit is stored in the cabinet and also relatively small in size, a rotating sound of the fans or the like of the fan unit does not leak outside the cabinet, thereby preventing a voice-listening environment from deterioration.

As described above, the number of bass-reflex ducts is not limited to two. In the case of the number of bass-reflex ducts other than two, the numbers of the air-intake and air-discharge bass-reflex ducts are not needed to be equal to each other. For example, a single air-intake bass-reflex duct and two air-discharge bass-reflex ducts may be disposed.

The fan unit can be disposed at appropriate positions. For example, a plurality of fan units may be disposed at appropriate positions, for example, in the vicinities of the air-intake and air-discharge bass-reflex ducts, or at an arbitrary positions between the air-intake and air-discharge bass-reflex ducts. That is, the numbers of bass-reflex ducts and the fan units, in addition, the numbers of the air-discharge and air-intake bass-reflex ducts can be appropriately set depending on its design requirements.

BRIEF DESCRIPTION OF THE DRAWINGS

FIG. 15 is an illustration of providing expressions for computing the lowest resonant frequency and the resonant frequency of, respectively, the speaker unit and the speaker cabinet of the bass-reflex speaker shown in FIGS. 1A and 1B.

DESCRIPTION OF THE PREFERRED EMBODIMENTS

Embodiments of the present invention will be described with reference to the attached drawings.

First Embodiment

A speaker apparatus according to an embodiment of the present invention will be described.

Figure 1A:
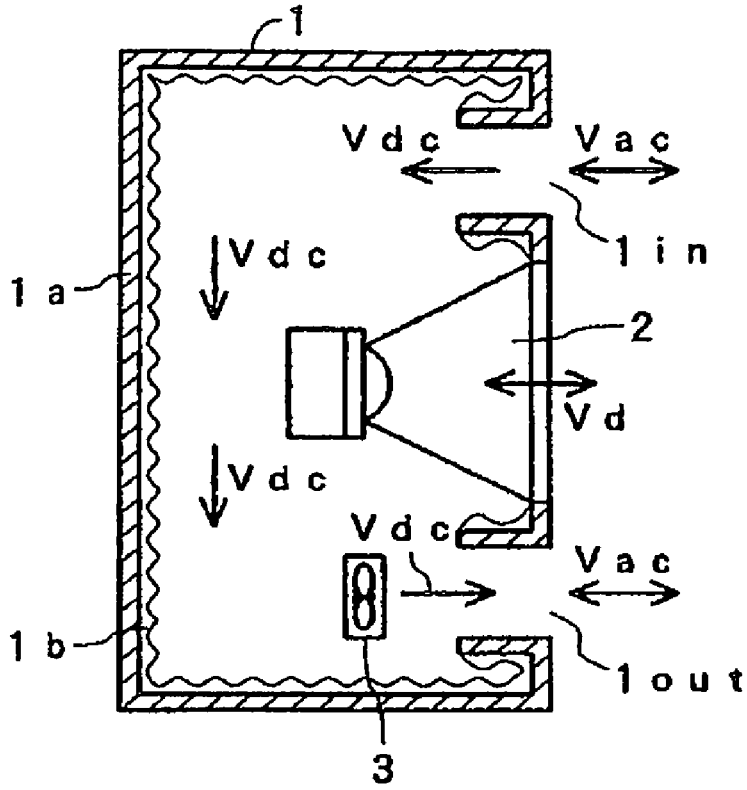
FIGS. 1A and 1B illustrate a speaker apparatus according to an embodiment of the present invention.
Figure 1B:
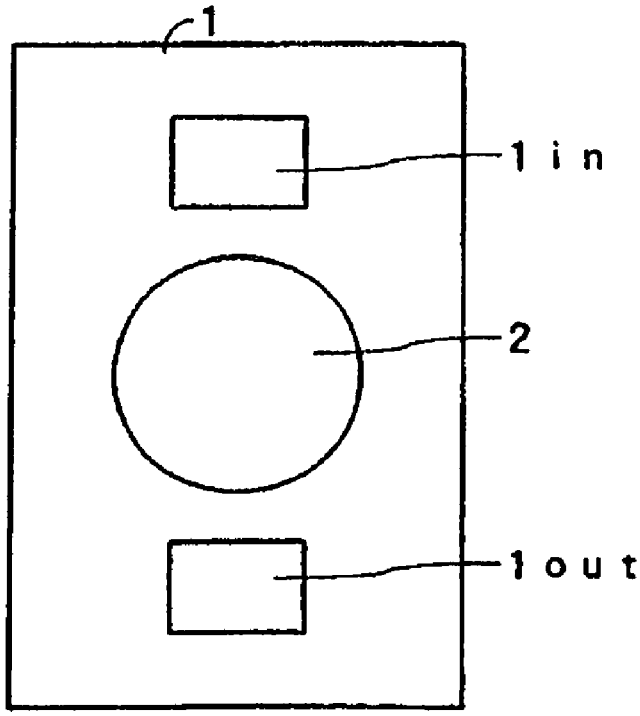

FIG. 1 illustrates the speaker apparatus according to the embodiment, wherein FIG. 1A is a sectional view of the speaker apparatus cut away along a surface orthogonal to its sound-emitting surface, and FIG. 1B is an elevational view of the same.

As shown in FIGS. 1A and 1B, while a speaker cabinet 1 has a speaker unit 2 disposed therein, in this example case, the cabinet 1 also has bass-reflex ducts 1in and 1out at positions so as to face each other, having the speaker unit 2 sandwiched therebetween. That is, the speaker apparatus according to the embodiment has two bass-reflex ducts disposed therein.

Figure 13A:
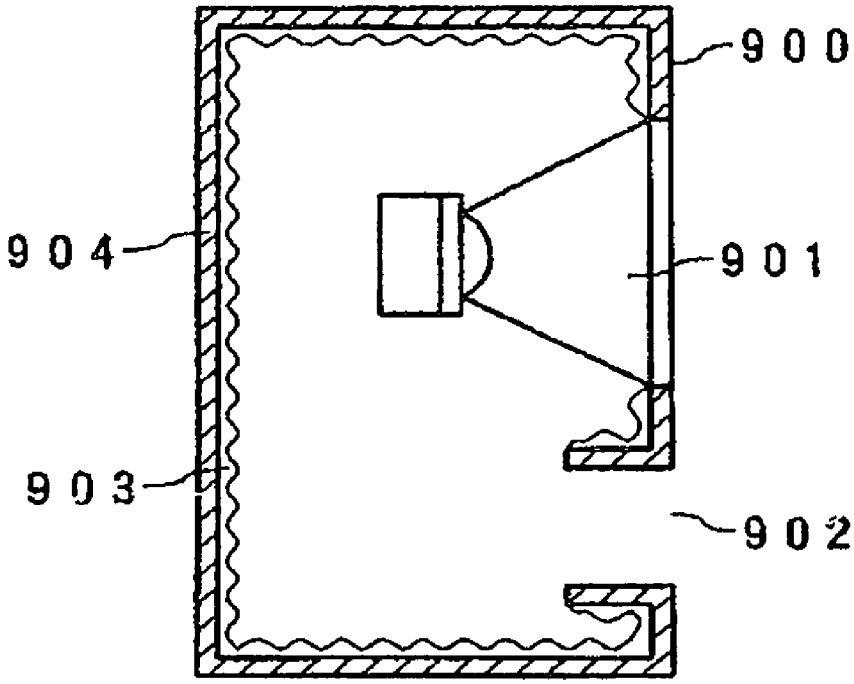
FIGS. 13A and 13B illustrates a known bass-reflex speaker.
Figure 13B:
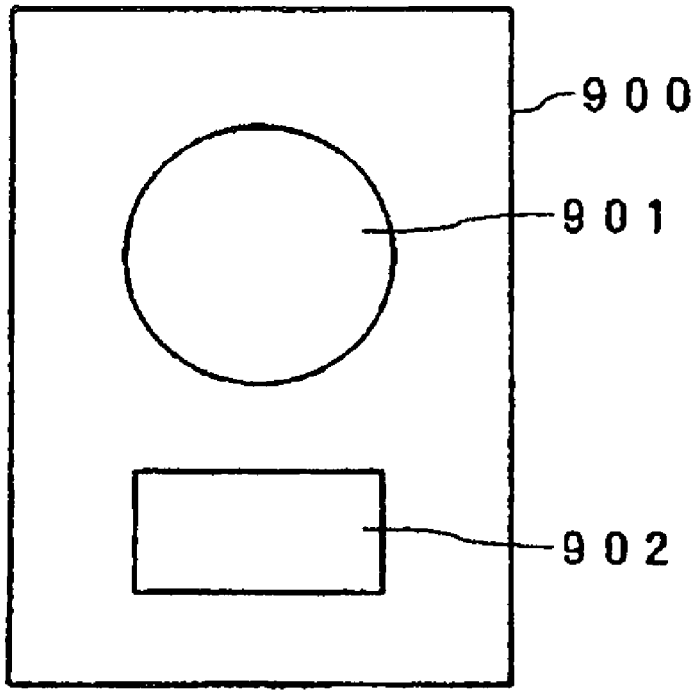

In this case, the speaker apparatus is formed such that the area of the opening of each of the bass-reflex duct 1in and the bass-reflex duct 1out and the length of each duct extending inward the speaker cabinet 1 agree respectively with the area of the opening and the length of a bass-reflex duct 902 extending inward a speaker cabinet 900 of a known bass-reflex speaker apparatus shown in FIG. 13. Accordingly, the speaker apparatus shown in FIG. 1 has an equivalent circuit shown in FIG. 14 in the same fashion as in the known apparatus.

In the speaker apparatus according to the present embodiment, as shown in FIG. 1A, the speaker cabinet 1 has a fan unit 3 disposed therein, in the vicinity of the bass-reflex duct 1out, and serving as air-blowing means. The fan unit 3 blows air toward the opening the bass-reflex duct 1in as shown by an arrow indicated in FIG. 1.

With this structure, a flow of air is formed in the speaker cabinet 1 as shown by the arrow, as a result, the bass-reflex ducts 1in and 1out can be exclusively used for air-intake and for air-discharge, respectively.

When a musical signal voltage is applied on the speaker apparatus shown in FIG. 1, according to the present embodiment, an electric current corresponding to the voltage flows, and the pressure of a sound emitted from a cone of the speaker unit 2 and the pressures of sounds emitted from the bass-reflex duct 1in and 1out are combined with each other, thereby playing back a voice having a satisfactory low-tone frequency characteristic. When the fan unit 3 is not used on this occasion, a flow (vibration) of air in the bass-reflex ducts 1in and 1out is occupied only by an alternating component (AC) as shown by arrow Vac indicated in FIG. 1A.

With the fan unit 3, when air is blown toward the opening of the bass-reflex duct 1out, as shown by arrow Vdc indicated in FIG. 1A, the bass-reflex duct 1in of the two bass-reflex ducts has a constant flow of air flowing from the outside to the inside of the speaker cabinet 1, and the other one, that is, the bass-reflex duct 1out has a constant flow of air flowing from the inside to the outside of the speaker cabinet 1, having the same amount as that of air flowing in the cabinet 1.

Figure 14:
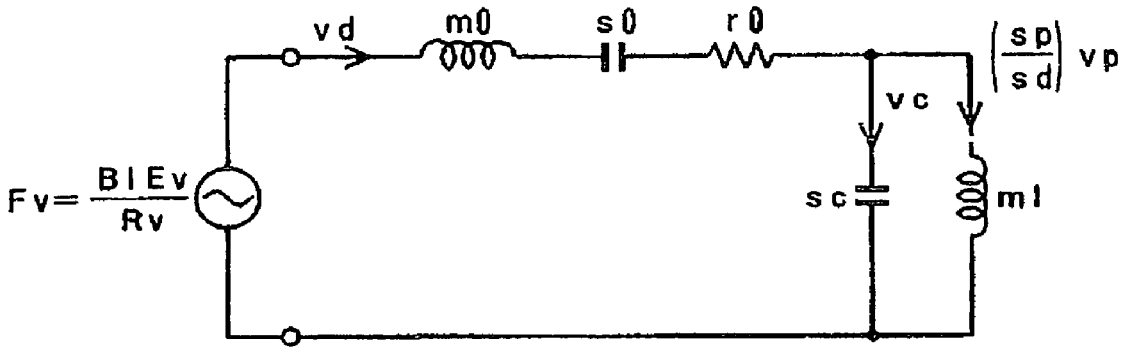
FIG. 14 illustrates a simplified equivalent circuit of the bass-reflex speaker apparatus shown in FIGS. 1A and 1B.

With this arrangement, the bass-reflex ducts 1in and 1out have an air flow in a state in which a direct current (DC) component of air blown by the fan unit 3 and an alternating current (AC) component of air generated by a musical signal are superimposed with each other. This indicates that an AC current and a DC current in an equivalent circuit of the speaker apparatus shown in FIG. 14 are superimposed with each other.

In this case, even when DC air is flown in the bass-reflex ducts, the frequency characteristic of the bass-reflex speaker apparatus is the same as that in the case where no DC air flows, whereby no change in the characteristic is made. Even when direct current air is flown in bass-reflex ducts disposed at a plurality of positions of the cabinet, an advantage specific to the bass-reflex speaker apparatus, that is, improving a bass-reproduction characteristic by resonance of the cabinet is likewise achieved.

In addition, since external fresh air can be taken in the speaker cabinet 1, and the same amount of air in the speaker cabinet 1 as that of taken-in fresh air can be discharged outside, the inside of the speaker cabinet 1 can be effectively cooled.

In other words, while improving a bass-reproduction characteristic of the bass-reflex speaker apparatus, by passing DC air through a plurality of the bass-reflex ducts disposed in the speaker cabinet, air in the speaker cabinet is discharged, and by taking external air in the speaker cabinet, the inside of the speaker cabinet is cooled.

Figure 2:
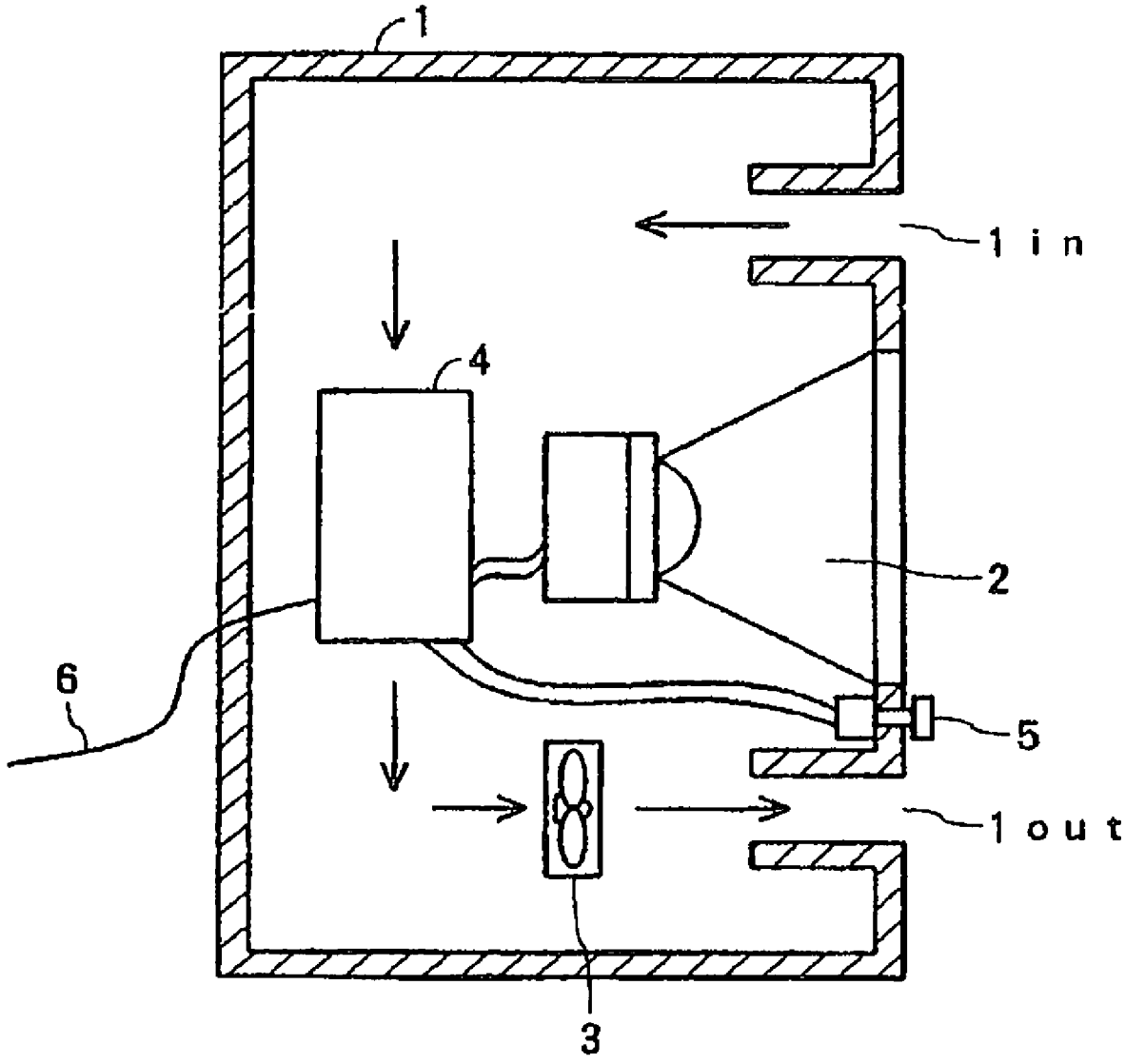
FIG. 2 illustrates the structure of the speaker apparatus according to the embodiment.

With this arrangement, even when an electronic circuit of an amplifier circuit 4 and the like dissipating heat are built in the speaker cabinet 1 as shown in FIG. 2 by way of example, the speaker cabinet can be achieved without a complicated structure for heat dissipation and increase in cost, also without countermeasures such as prohibiting increase in the temperature in the speaker cabinet 1 and also the maximum power of the amplifier circuit 4.

Second Embodiment

A plasma display device, having a speaker unit incorporated therein, and serving as an example electronic apparatus according to a second embodiment of the present invention will be described.

Figure 3A:
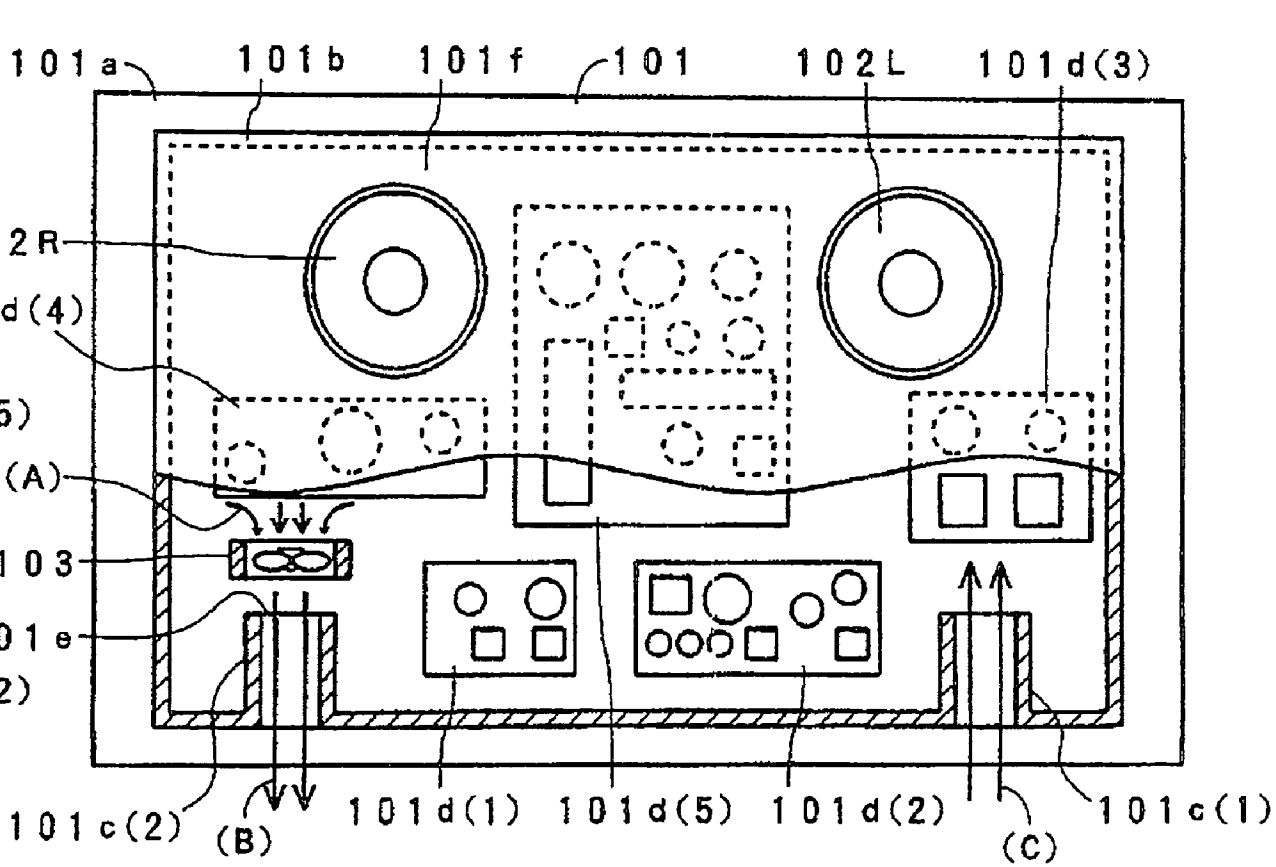
FIGS. 3A and 3B illustrate a plasma display device as an example electronic apparatus according to an embodiment of the present invention.
Figure 3B:
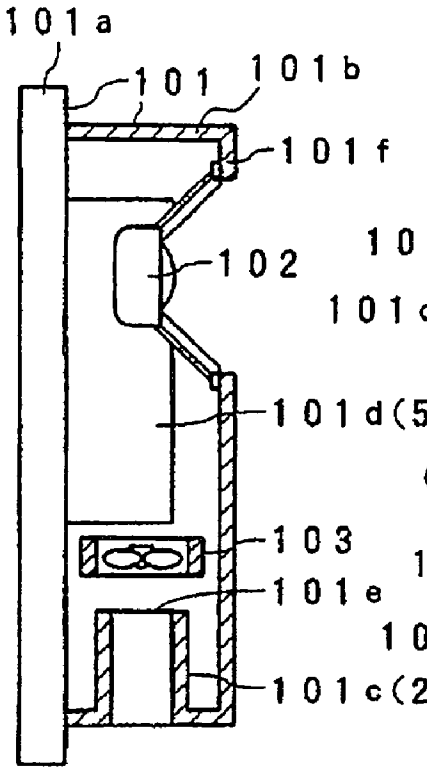

FIG. 3 illustrates a plasma display device 100 according to the second embodiment of the present invention, wherein FIG. 3A is a sectional view in part of the plasma display device 100, cut away along a plane parallel to a display screen of its display section and viewed from the opposite side to the display, and FIG. 3B is a sectional view of the same, close to the side surface and cut away along a plane orthogonal to the display screen.

As shown in FIG. 3, the plasma display device 100 includes a display section 101*a*; a cabinet 101*b* covering electronic circuit sections thereof and also serving as a speaker cabinet; two bass-reflex ducts 101*c* (1) and 101*c* (2); and a plurality of electronic circuits 101*d* (1), 101*d* (2), 101*d* (3), 101*d* (4), and 101*d* (5). The cabinet 101*b* serving also as the speaker cabinet has speaker units 102L and 102R disposed on a rear surface 101*f* thereof. While having two speaker units, this example plasma display device may have a single unit or a large number of units.

The cabinet 101*b* has a fan unit 103 disposed therein, for generating a DC air flow. The fan unit 103 is arranged so as to face an opening 101*e* of the bass-reflex duct 101*c* (2). When air is blown from the fan unit 103, the air is flown out externally through the bass-reflex duct 101*c* (2). Also, as shown in FIG. 3, the opening 101*e* of the bass-reflex duct 101*c* (2) and the fan unit 103 do not closely contact with each other and are arranged so as to be kept away from each other to a certain degree, thereby preventing deterioration of a bass-reflex effect.

The speaker unit 102L and 102 R are fixed to the rear surface 101*f* of the cabinet 101*b*, and, due resonance between the speaker units 102L and 102R and the cabinet 101*b* having the bass-reflex ducts 101*c* (1) and 101*c* (2) disposed therein, a bass-reproduction characteristic is improved in the same fashion as in a known bass-reflex speaker apparatus.

As described above, the plasma display device 100 has the plurality of electronic circuits 101*d* (1), 101*d* (2), 101*d* (3), 101*d* (4), and 101*d* (5) disposed therein, for outputting a picture or a voice and driving itself. Hence, the electronic circuits 101*d* (1), 101*d* (2), 101*d* (3), 101*d* (4), and 101*d* (5) generate heat.

Figure 4A:
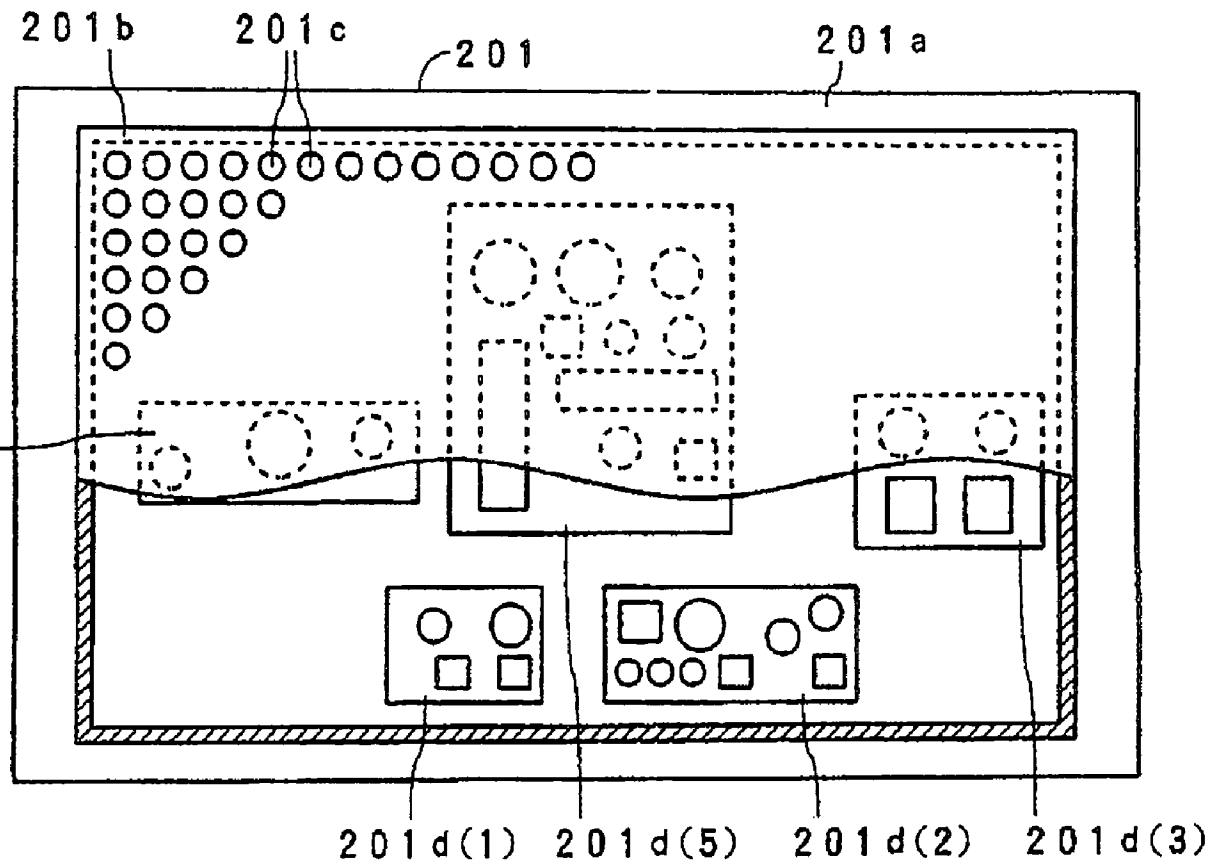
FIGS. 4A and 4B illustrate a known plasma display device.
Figure 4B:
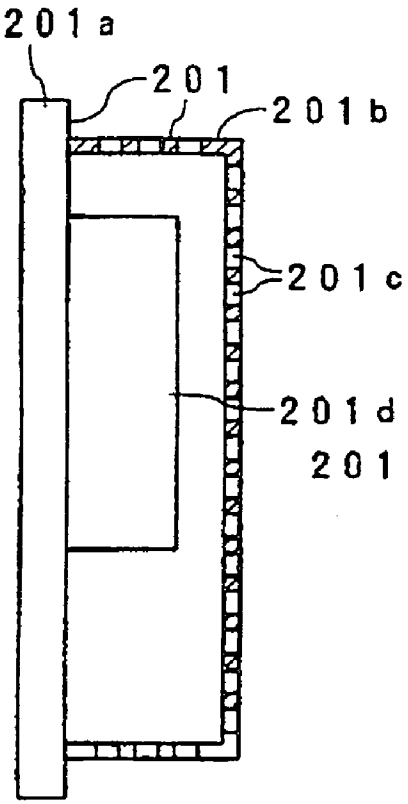

As a countermeasure against such a case, generally as in a cabinet 201*b* of a known a plasma display device 200 shown in FIG. 4, by providing a very large number of air-passing holes 201*c* to the cabinet 201*b* covering electronic circuits 201*d* (1), 201*d* (2), 201*d* (3), 201 (4), and 201*d* (5), heat is prevented from remaining in the cabinet and, at the same time, the electronic circuits 201*d* (1), 201*d* (2), 201*d* (3), 201*d* (4), and 201*d* (5) are cooled by heat sinks or the like disposed in the corresponding circuits.

In the meantime, concerning the plasma display device 100 shown in FIG. 3, according to the second embodiment, the cabinet 101*b* has no cooling air holes disposed therein; alternatively, the fan unit 103 sucks air in the cabinet 101*b*, flowing shown by arrow (A) indicated in the figure, and pushes it out in the forward direction of the fan unit 103, whereby air flows out externally, as shown by arrow (B) indicated in the figure, through the opening 101*e* of the bass-reflex duct 101*c* (2) facing the fan unit 103.

Consequently, the pressure in the cabinet 101*b* decreases, and external air flows in the cabinet 101*b* through the bass-reflex duct 101*c* (1) serving as the other one of ducts, as shown by arrow (C) indicated in the figure, whereby air in the cabinet 101*b* heated by heating by the electronic circuits 101*d* (1), 101*d* (2), 101*d* (3), 101*d* (4), and 101*d* (5) is externally discharged, and relatively cool external air is taken in the cabinet 101*b*, resulting in cooling the inside of the cabinet 101*b*.

Since the series of air flows (A), (B) and (C) is always constant and remains unchanged, the flows can be called a so-called DC airflow. As shown in FIG. 3, the fan unit 103 is arranged so as not to closely contact with the opening 101*e* of the bass-reflex duct 101*c* (2) and not to prevent an alternating vibration of air when passing through the bass-reflex duct 101*c* (2).

With this structure, without deterioration in improvement effect of a bass-reproduction characteristic, specific to the bass-reflex speaker apparatus, due to resonance between the speaker unit and the speaker cabinet having the bass-reflex ducts incorporated therein, by passing DC air pass through the bass reflex ducts, air in the cabinet 101*b* is discharged, and external air is taken in the same, thereby resulting in cooling the inside of the cabinet 101*b*.

While only two bass-reflex ducts 101*c* are provided in the plasma display device shown in FIG. 3 so as to take in external air having an amount corresponding to that of discharged one, two or more bass-reflex ducts can be arranged as long as the overall bass-reflex ducts are formed so as to achieve an improved bass reproduction effect.

While, with respect to the two bass-reflex ducts 101*c* (1) and 101*c* (2), a single of the fan unit 103 is provided in the present embodiment shown in FIG. 3, it will be appreciated that a plurality of the fan units 103 can be provided having the same number as that of the bass-reflex ducts 101*c*. Since the cabinet 101*b* serving as the speaker cabinet has no portions other than the bass-reflex ducts 101*c*, allowing air passing therethrough, even when at least one of a plurality of the bass-reflex ducts 101*c* can be arranged close to the fan unit 103 so as to actively move air, a change in pressure in the cabinet causes air in the other bass-reflex ducts to flow.

Modifications

Some modifications of the electronic apparatus according to the second embodiment will be described. Although a speaker unit is omitted for easy understanding in the figures used for the following illustrations, in any modification, a cabinet has the speaker unit disposed therein so as to serve as a speaker cabinet of a bass-reflex speaker apparatus, in the same fashion as in the plasma display device 100 shown in FIG. 3.

Figure 5:
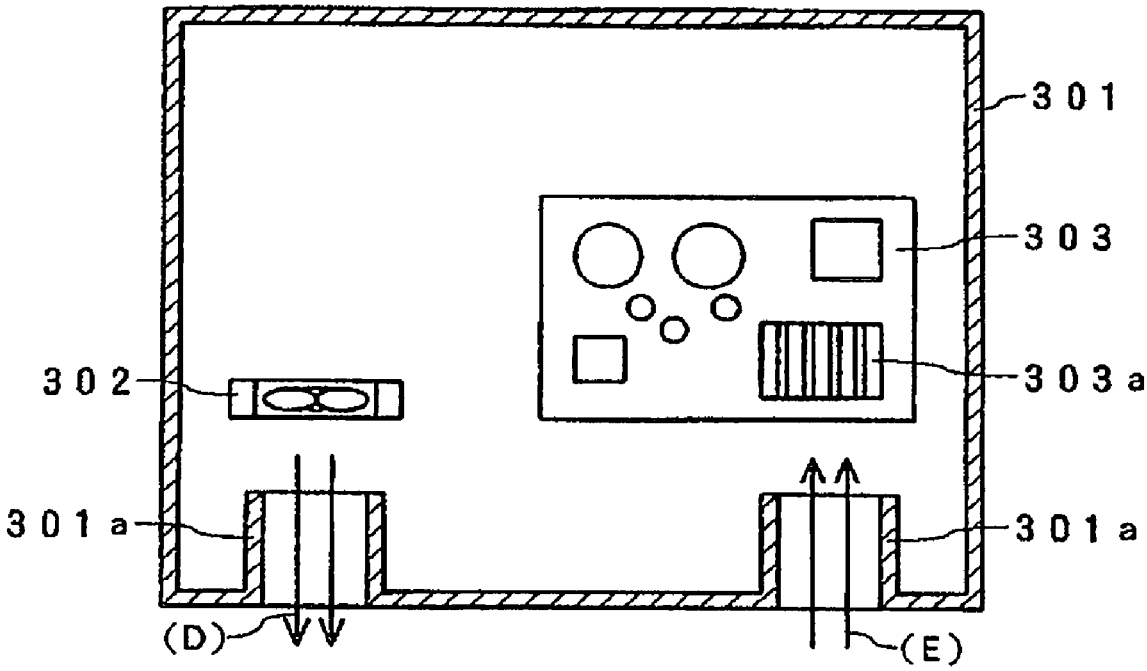
FIG. 5 illustrates a modification of the electronic apparatus according to the embodiment.

FIG. 5 illustrates an electronic apparatus as a modification of the second embodiment, having a circuit 303 having a heating section 303*a*, built therein. When air is blown by rotating fans of a fan unit 302, airflows are formed as shown by arrows (D) and (E) indicated in FIG. 5.

With this arrangement, the heating section 303*a* of the circuit 303 is disposed in a direction along which, as shown by arrow (E), relatively cool air flows from the outside to the inside a cabinet 301 through two bass-reflex ducts 301*a* disposed in a cabinets 301 so as to more effectively cool the heating section 303*a*. Although a speaker unit and so forth are omitted in FIG. 5 as described above, the basic operation of the electronic apparatus shown in FIG. 5 is the same as that shown in FIG. 3.

Figure 6:
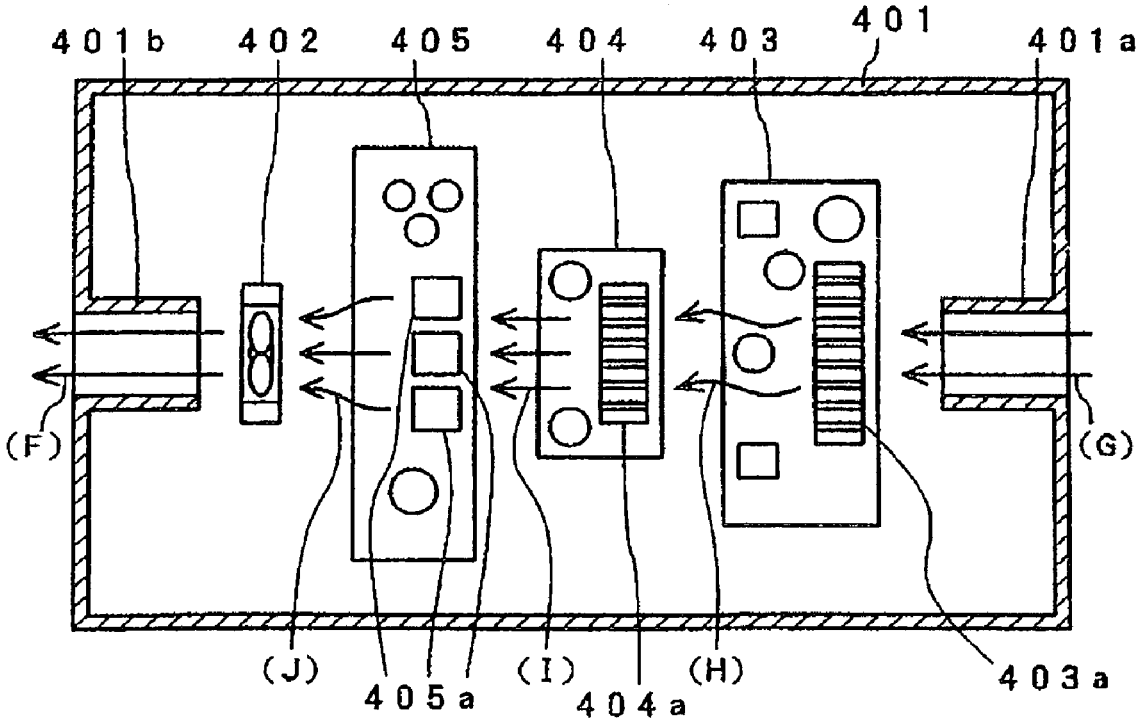
FIG. 6 illustrates another modification of the electronic apparatus according to the embodiment.

FIG. 6 illustrates an electronic apparatus as another modification of the second embodiment. A cabinet 401 has air-intake and air-discharge bass-reflex ducts 401*a* and 401*b* such that the two ducts are kept the most away from each other. The cabinet 401 has a plurality of electronic circuits 403, 404, and 405 disposed therein, respectively having heating sections 403*a*, 404*a* and 405*a*, while being arranged substantially linearly along a line connecting the air-intake and air-discharge ducts 401*a* and 401*b*.

By blowing air by rotating fans of a fan unit 402, when air in the cabinet 401 is discharged as shown by arrow (F) indicated in the figure, due to a change in the pressure in the cabinet, external air is flown in the cabinet through the intake duct 410*a* as shown by arrow (G) indicated in the figure. The air flows as shown by arrow (H) indicated in the figure while cooling the heating section 403*a* of the electronic circuit 403; then, flows as shown by arrow (I) indicated in the figure while cooling the heating section 404*a* of the electronic circuit 404; subsequently, flows as shown by arrow (J) indicated in the figure while cooling the heating section 405*a* of the electronic circuit 405; and is discharged outside by the fan unit 402. With this arrangement, the heating sections of the plurality of electronic circuits disposed in the cabinet are cooled.

Although the heating sections 403*a*, 404*a*, and 405*a* of the electronic circuits 403, 404 and 405 disposed in the cabinet 401 sometimes generate different amounts of heat from one another, by disposing the electronic circuits generating larger amount of heat than the others close to the discharge bass-reflex duct 401*b*, the cabinet can be effectively cooled.

Figure 7:
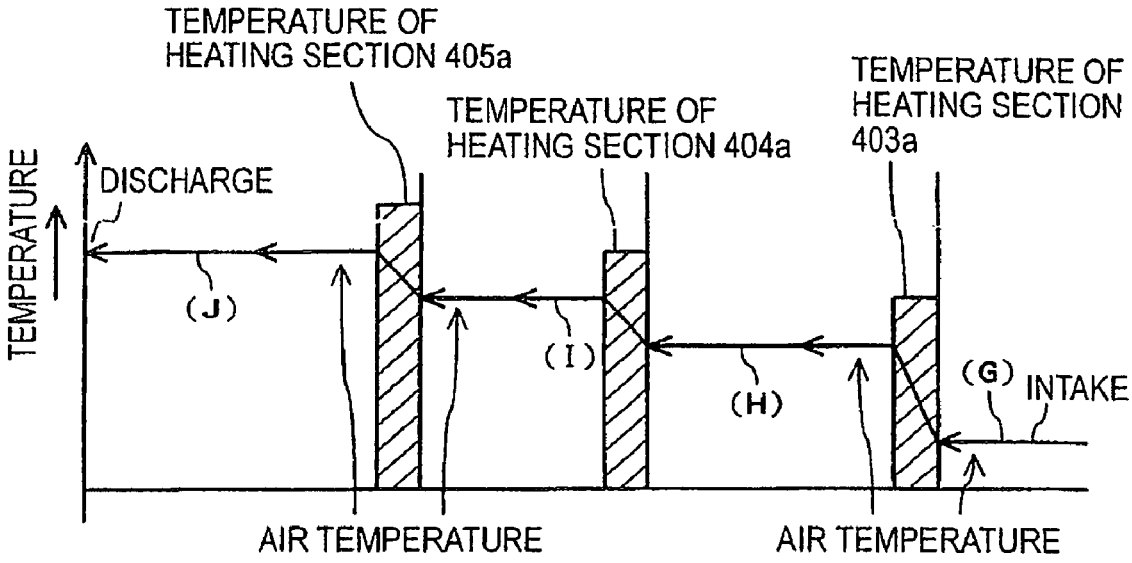
FIG. 7 illustrates a cooling operation of the electronic apparatus shown in FIG. 6.

FIG. 7 illustrates temperatures of the electronic circuits 403, 404, and 405 disposed in the cabinet 401 by a histogram, in addition to illustrating a change in temperature of air passing through the respective electronic circuits by a sequential line graph (shown by an arrow), and the direction of an airflow is indicated by the arrow of the sequential line graph.

As shown in FIG. 7, the temperatures of the respective heating sections 403*a*, 404*a*, and 405*a* of the electronic circuits 403, 404, and 405 are getting higher in the order of the heating section 403*a*, 404*a*, and 405*a*. In this case, as shown in FIG. 6, external cool air flown in the cabinet 401 as shown by arrow (G) passes through the heating section 403*a* first while cooling the same. On this occasion, the temperature of the passing-through air (H) rises as shown by an arrow indicated in FIG. 7, corresponding to cooling the heating section 403*a*.

Then, the air passes through the heating section 404*a*. When the temperature of the heating section 404*a* exceeds that of the air (H) passing through the heating section 403*a* on this occasion, the heating section 404*a* is cooled, and the temperature of the air (I) passing through the heating section 404*a* further rises. Then the air passes through the heating section 405*a*. When the temperature of the heating section 405*a* exceeds that of the air (I) passing thorough the heating section 404*a* on this occasion, the heating section 405*a* is further cooled, and the temperature of the air (J) passing through the heating section 405*a* rises further.

As described above, when the heating sections of the respective electronic circuits are arranged along the flow of air in order of increasing heating temperature of the heating sections, the heating sections are cooled at the respective electronic circuits.

Figure 8:
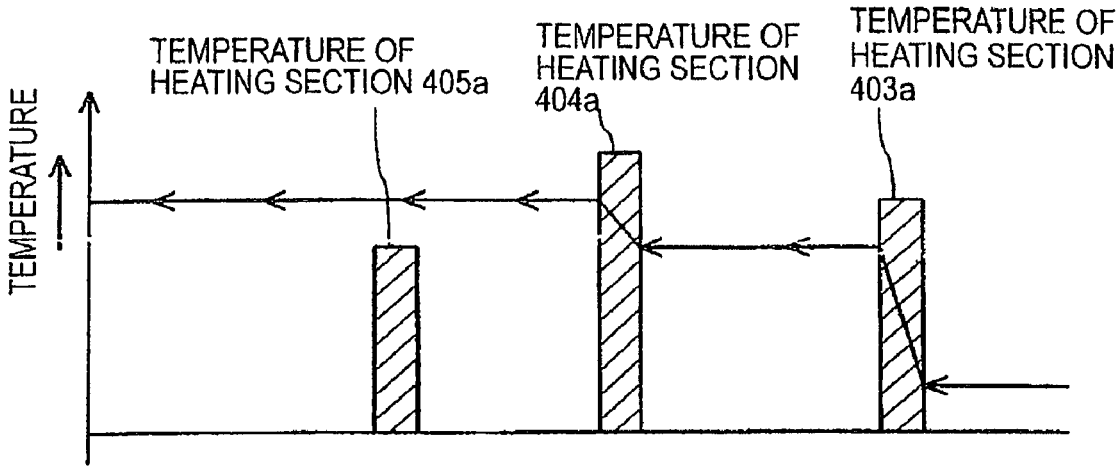
FIG. 8 illustrates another cooling operation of the electronic apparatus shown in FIG. 6.

Tentatively assuming that the temperature of the heating section 404*a* is highest, the temperature of the heating section 403*a* is second highest, and the temperature of the heating section 405*a* is lowest as shown in FIG. 8, when the temperature of air passing through the heating sections 403*a* and 404*a* exceeds that of the heating section 405*a*, since the heating section 405*a* cannot be cooled, the heating sections of the other electronic circuits are cooled, thereby prohibiting a rise in temperature of these heating sections and accordingly, preventing a rise in the temperature in the cabinet 401 even when the heating sections are not arranged in order of increasing temperature.

Figure 9:
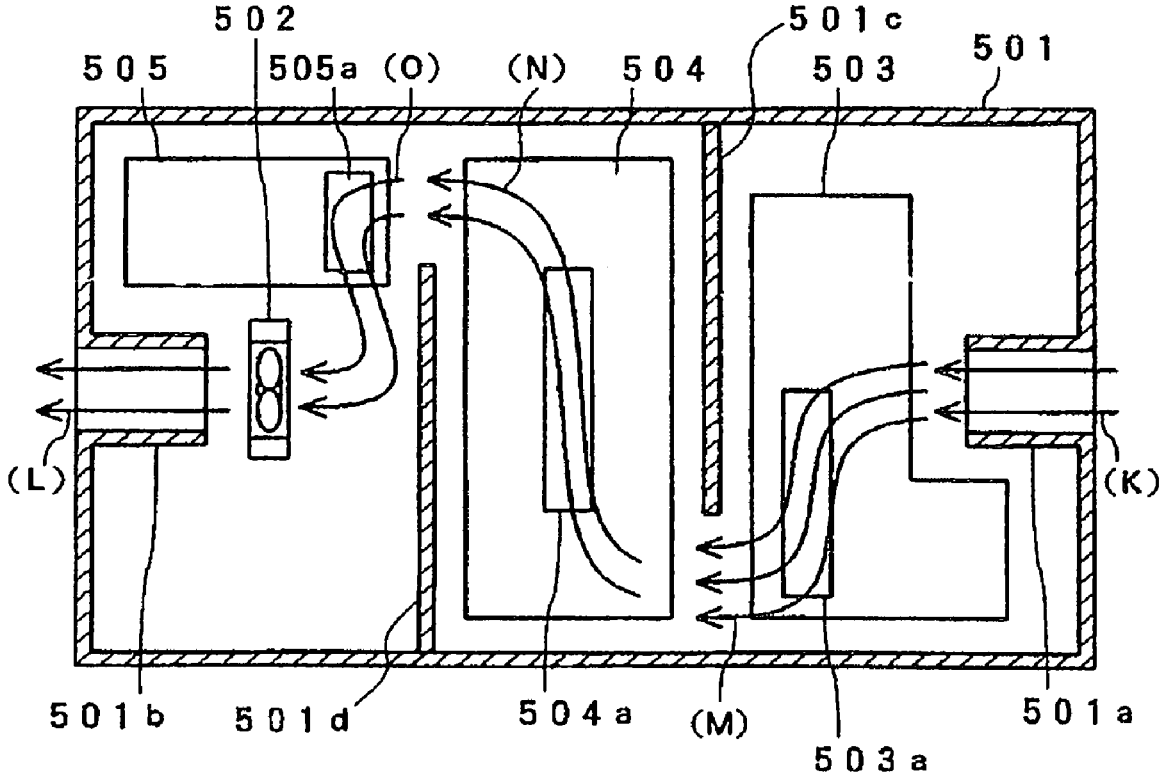
FIG. 9 illustrates another modification of the electronic apparatus according to the embodiment.

FIG. 9 illustrates an electronic apparatus as another modification of the second embodiment. A cabinet 501 has air-straightening plates 501*c* and 501*d* disposed therein. By blowing air by rotating fans of a fan unit 502 so as to produce an airflow as shown by an arrow extending from (K), (M), (N), (O), and to (L), heating sections 503*a*, 504*a*, and 505*a* of electronic circuits 503, 504, 505 are cooled without substantially linear arrangement.

Figure 10:
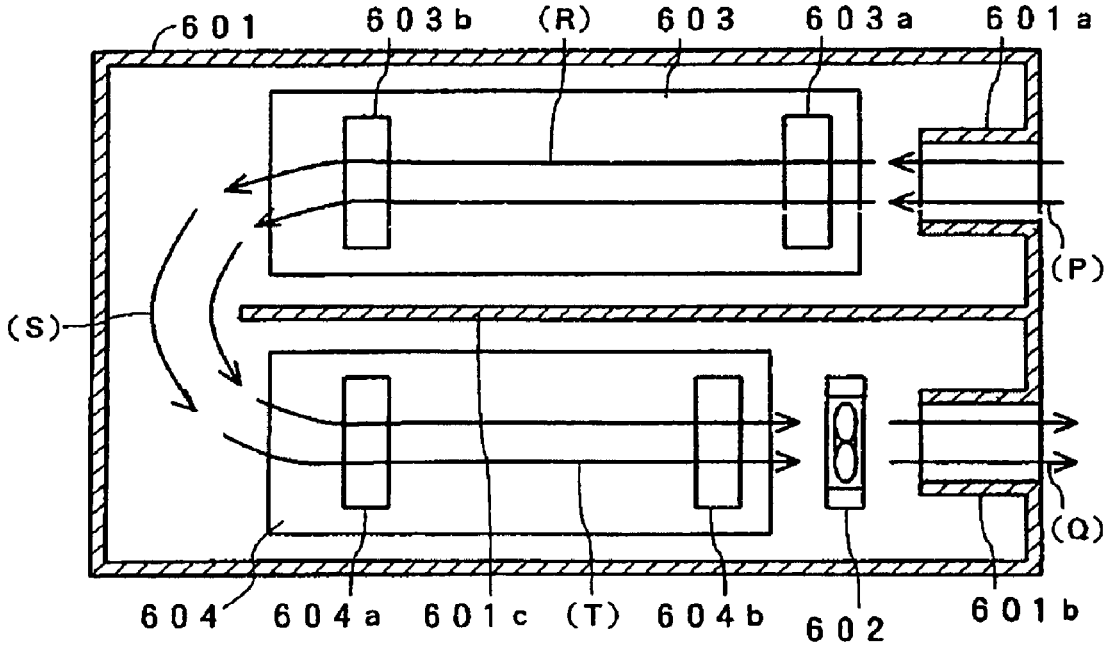
FIG. 10 illustrates another modification of the electronic apparatus according to the embodiment.

FIG. 10 illustrates an electronic apparatus as another modification of the second embodiment. A cabinet 601 has an air-intake duct 601*a*, an air-discharge duct 601*b*, and an air-straightening plate 601*c* disposed therein as shown in the figure. When air is discharged by a fan unit 602 through the duct 601*b* as shown by arrow (Q) in the figure, external air is taken in the cabinet through the duct 601*a* and flows along an airflow shown by an arrow extending from (P), (R), (S), to (T). When heating sections 603*a*, 603*b*, 604*a*, and 604*b* of electronic circuits 603 and 604 are arranged as shown in the figure, all these heating sections are cooled by the air flowing as described above, and the heated air is discharged by the fan unit 602 as shown by arrow (Q).

As will be understood from the above description, by disposing the air-straightening plate 601*c*, the heating sections of a plurality of the electronic circuits disposed in the cabinet serving as a speaker cabinet are cooled without arranging the air-intake duct 601*a* and the air-discharge duct 601*b* so as to be kept the most away from each other in the cabinet.

Figure 11:
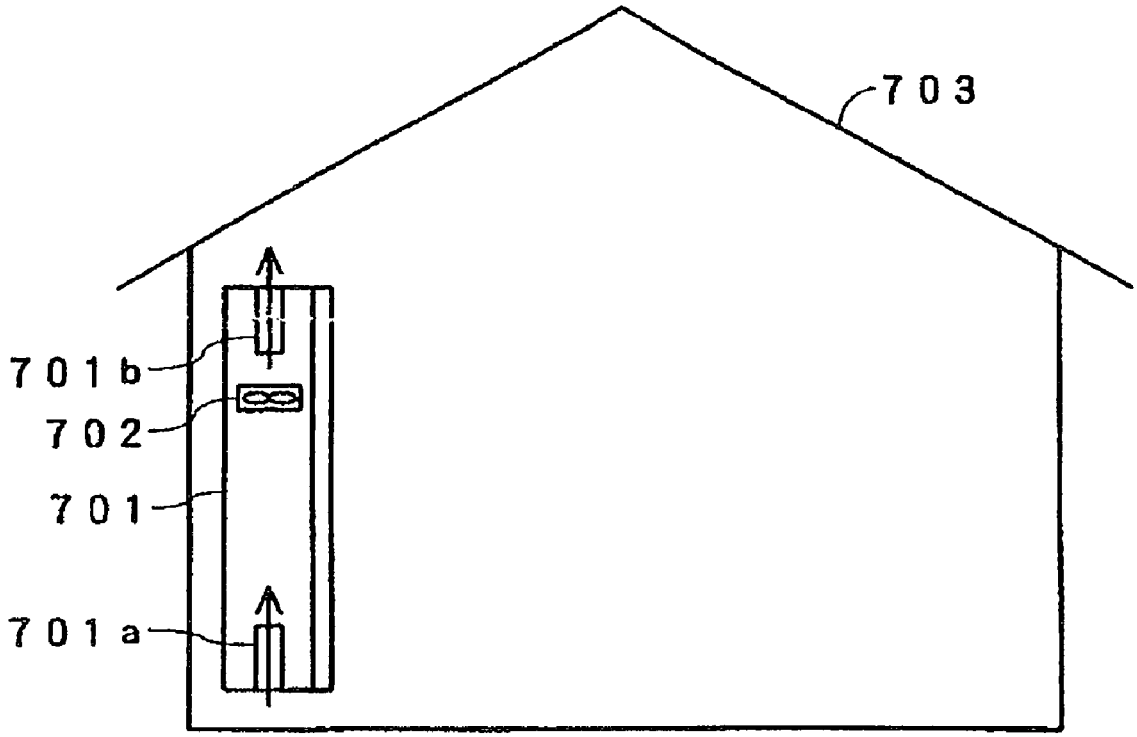
FIG. 11 illustrates another modification of the electronic apparatus according to the embodiment.

FIG. 11 is a schematic diagram of a house, illustrating a plasma display device as another modification of the second embodiment. A house 703 has an example wide-screen plasma display device 701 installed therein, vertically having a certain height (length) as shown in the figure. When the house, for example, in a cold district, has a heating apparatus installed in a room thereof, relatively hot air and cool air remain at upper and lower parts of the room, respectively. When the plasma display device 701 is arranged in such a place as shown in FIG. 11, the lower and upper parts of the plasma display device 701 lie respectively in hot and cold air atmospheres.

As a countermeasure against such a problem, the plasma display device 701 shown in FIG. 11 is formed such that bass-reflex ducts 701*a* and 701*b* are vertically disposed in a cabinet serving as a speaker cabinet and that the lower and upper ducts 701*a* and 701*b* are respectively used as air-intake and air-discharge ducts. Hence, a fan unit 702 is disposed close to the discharge bass-reflex duct 701*b* disposed at upper part of the cabinet.

With this structure, relative cool external air is taken in the cabinet, thereby effectively cooling the heating sections of the electronic circuits.

Further, as shown in FIG. 11, when the air-intake and air-discharge duct 701*a* and 701*b* are respectively disposed at the lower and upper parts of the display device, air taken in through the air-intake duct 701*a* is heated by heating sections of electronic circuits (not shown) and is discharged through the air-discharge duct 701*b* by the fan unit 702. Since air heated in the cabinet on this occasion has a smaller weight, the air moves up by itself.

Although air is in general forcefully discharged outside the apparatus by the fan unit 702, in the cases of power failure or turning off the power of the plasma display device 701 immediately after use of the display device in which the heating sections are still hot, by respectively disposing the intake and discharge bass-reflex ducts 701*a* and 701*b* respectively at the lower and upper part of the display device as shown in FIG. 11, air heated in a cabinet serving as a speaker cabinet of the plasma display device 701 and having a smaller weight moves up spontaneously and is discharged through the bass-reflex duct 701*b*.

At the same time, air having an amount corresponding to that of discharged air is taken in through the lower intake duct. Then, the air is again heated, moves up, and is discharged. When this operation is repeated, internal air is replaced with external air, and the inside of the cabinet is cooled. That is, even after use of the plasma display device 701, the inside of the cabinet having remaining heat therein is effectively cooled, thereby satisfactorily maintaining the plasma display device 701.

Figure 12:
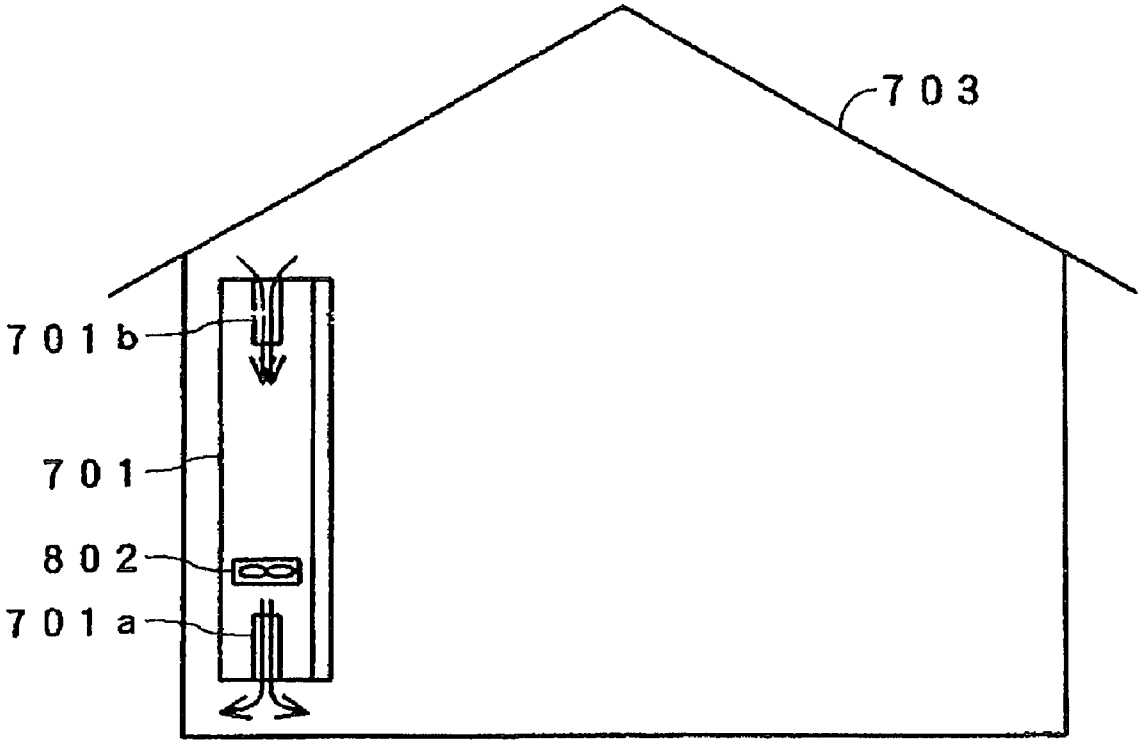
FIG. 12 illustrates another modification of the electronic apparatus according to the embodiment.

FIG. 12 illustrates another modification of the electronic apparatus, illustrating a modified plasma display device having substantially the same structure as that of the plasma display device 701 shown in FIG. 11. As shown in FIG. 12, the modified plasma display device 701 has a structure in which a fan unit 802 is disposed in the vicinity of the lower bass-reflex duct 701*a* so as to use the upper and lower bass-reflex ducts 701*b* and 701*a* respectively for air-intake and air-discharge. With this arrangement, In the case of the plasma display device 701 is in non-operation, when making only the fan unit 802 is made in operation, air in the room forms a flow, thereby making the temperature of the room more uniform. In other words, the plasma device can be used also as an air-circulator.

As a matter of course, by making the fan unit 802 being in operation, the inside of the plasma display device 701 can be cooled. In this case, when only the fan unit 802 is driven while the plasma display device 701 is driven by built-in electronic circuits, each having a heating section, air discharged through the lower discharge duct becomes hotter, thereby making the room temperature more uniform.

Figure 16:
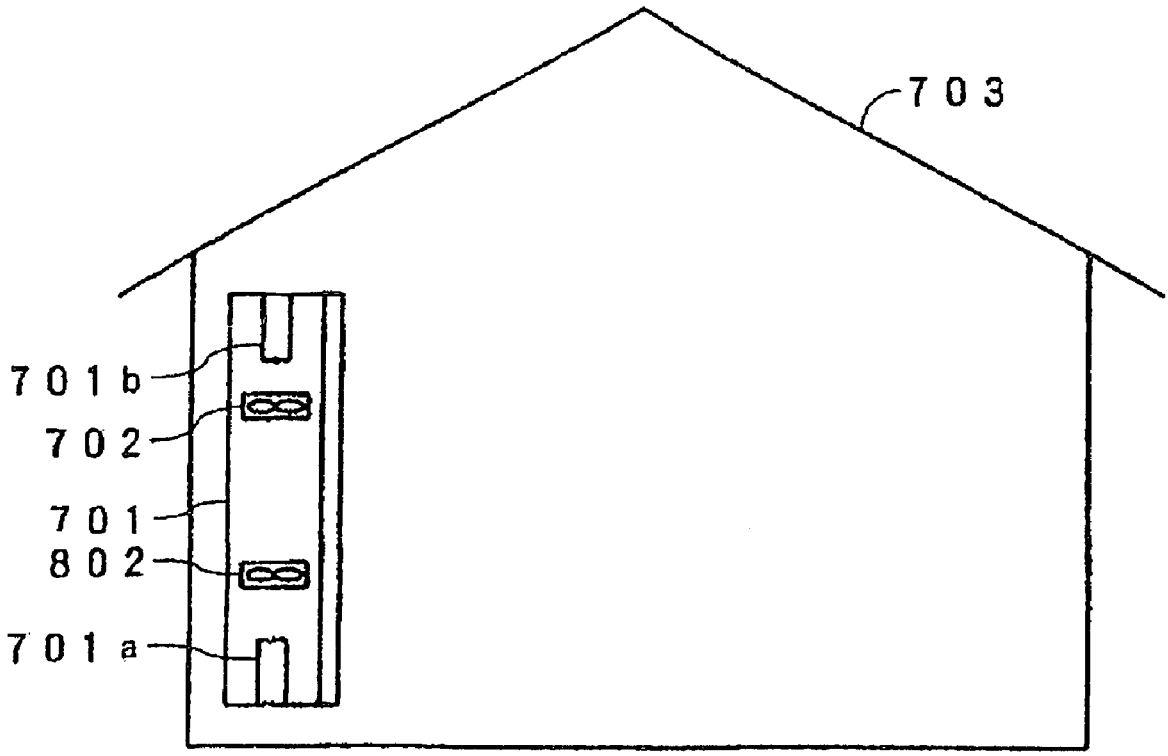
FIG. 16 illustrates another modification of the electronic apparatus according to the embodiment.

Accordingly, by disposing the fan units disposed close to the bass-reflex ducts 701*b* and 701*a* respectively disposed at the lower and upper parts of the plasma display device 701 such as when the arrangements of FIGS. 11 and 12 are combined (FIG. 16), these fan units may be arranged so as to be switched to each other, or an operator may arbitrarily select one of the fan units, for example, in accordance with a room temperature, or an operative/non-operative operation of the plasma display device 701.

While a speaker apparatus and a plasma display device, to which the present invention is applied, are described by way of example in the above-described embodiments, the present invention is not limited to them. The present invention is also applicable to a variety of electronic apparatuses such as playback equipment including a radio receiver, a compact disc, a mini-disc, and a digital versatile disc, each having a speaker unit incorporated in its cabinet.

What is claimed is:

1. An electronic apparatus, comprising:

a cabinet having a speaker unit disposed therein;

at least two bass-reflex ducts disposed in the cabinet, in which said at least two bass-reflex ducts include a first bass-reflex duct and a second bass-reflex duct vertically disposed in the cabinet such that the first bass-reflex duct is arranged vertically above the second bass-reflex duct; and a first blowing unit and a second blowing unit, each of said first blowing unit and said second blowing unit being disposed in the cabinet and being operable upon selection to enable a flow of air to be formed in the cabinet, said first blowing unit being arranged adjacent to and in line with an opening of the first bass-reflex duct and said second blowing unit being arranged adjacent to and in line with an opening of the second bass-reflex duct, and during operation, one of said first blowing unit or said second blowing unit being selected for use such that a corresponding one of the first bass-reflex duct or the second bass-reflex duct is used for an air-discharge through which the air is discharged and the other one of the first bass-reflex duct or the second bass-reflex duct is used for an air-intake through which the air is inputted.

2. The electronic apparatus according to claim 1, further comprising a plurality of electronic circuits having respective heating sections, wherein the heating sections are disposed along the flow formed by the first blowing unit or the second blowing unit.

3. The electronic apparatus according to claim 1, wherein, the first bass-reflex duct and the second bass-reflex duct are further arranged in the cabinet so as to be separated from each other.

4. The electronic apparatus according to claim l, further comprising an air-straightening plate disposed in the cabinet for straightening direct flow of air in the cabinet so as to form a flow of air other than a straight one.

5. The electronic apparatus according to claim 1, further comprising a plurality of electronic circuits disposed in the cabinet having respective heating sections, wherein the heating sections are arranged along a direction of the direct flow of air formed in the cabinet, in order of increasing heating temperature.

* * * * *